US008744325B2

(12) United States Patent
Ino et al.

(10) Patent No.: US 8,744,325 B2
(45) Date of Patent: Jun. 3, 2014

(54) IMAGE FORMING APPARATUS FOR FORMING A DETECTION TONER PATTERN

(75) Inventors: Koichiro Ino, Kashiwa (JP); Hirokazu Kodama, Ryugasaki (JP); Mitsuhiro Sugeta, Abiko (JP); Takahiro Oonuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 313 days.

(21) Appl. No.: 13/107,801

(22) Filed: May 13, 2011

(65) Prior Publication Data

US 2011/0280633 A1 Nov. 17, 2011

(30) Foreign Application Priority Data

May 17, 2010 (JP) ..... 2010-113435
Apr. 4, 2011 (JP) ..... 2011-082981

(51) Int. Cl.
*G03G 15/01* (2006.01)

(52) U.S. Cl.
USPC ..... 399/301

(58) Field of Classification Search
USPC ..... 399/301; 347/116
See application file for complete search history.

(56) References Cited

U.S. PATENT DOCUMENTS

| | | | | |
|---|---|---|---|---|
| 5,537,190 | A * | 7/1996 | Folkins et al. | 399/41 |
| 6,674,988 | B2 * | 1/2004 | Kawanishi | 399/301 |
| 7,689,151 | B2 * | 3/2010 | Katsuhara et al. | 399/301 |
| 2008/0226360 | A1 * | 9/2008 | Sugiyama | 399/301 |
| 2009/0080915 | A1 * | 3/2009 | Hashimoto | 399/39 |

FOREIGN PATENT DOCUMENTS

JP 2007-156159 A 6/2007

* cited by examiner

*Primary Examiner* — Sandra Brase
(74) *Attorney, Agent, or Firm* — Canon USA Inc. IP Division

(57) ABSTRACT

A color image forming apparatus configured to form a combination toner pattern including a second toner image formed downstream in a conveying direction of an intermediate transfer belt on a first toner image and a third toner image formed upstream in the conveying direction of the intermediate transfer belt on the first toner image so that the second and the third toner images cover at least a portion of the first toner image.

8 Claims, 13 Drawing Sheets

IMAGE FORMING APPARATUS FOR FORMING A DETECTION TONER PATTERN

BACKGROUND OF THE INVENTION

1. Field of the Invention

The present invention relates to an image forming apparatus configured to form a color image of, for example, a copying machine, a printer, or a fax machine. More particularly, the present invention relates to an image forming apparatus capable of forming a detection toner pattern used for reducing color misregistration of toner images of each color.

2. Description of the Related Art

Copying machines and laser beam printers include an image forming apparatus that forms images through various processes by using the electrophotographic method. First, the surface of a photosensitive member is charged by a charging device. Then, a light beam is directed onto the photosensitive member which has been charged. When the light beam is directed onto the photosensitive member, according to the change in the electric potential of the surface of the photosensitive member, an electrostatic latent image is formed on the photosensitive member. The formed electrostatic latent image is developed by using charged toner which is charged to a predetermined charge. The developed toner image is transferred onto a recording medium such as paper, and the toner image transferred onto the recording medium is fixed onto the recording medium by a fixing unit.

Color image forming apparatuses that employ a method called a tandem method are known among the image forming apparatuses that form color images by using toner of multiple colors according to the electrophotography method. The tandem method uses a plurality of photosensitive members in forming the toner images. Each of the photosensitive members corresponds to toner having a different color. Each toner image having a different color formed on each photosensitive member is transferred onto a recording medium when the image is formed. Generally, a toner image formed on each photosensitive member is transferred onto an intermediate transfer member such as an intermediate transfer belt so that a toner image of one color is transferred onto another toner image on the intermediate transfer member. After then, the toner images on the intermediate transfer member are transferred onto the recording medium.

In such a color image forming apparatus, if there is positional misregistration of the toner images of each color transferred from each photosensitive member onto the intermediate transfer member, it may cause color misregistration on the recording medium. This may lead to reduced image quality.

In order to prevent such color misregistration, color misregistration correction control is performed using a toner pattern for color misregistration detection. The color misregistration correction control is a method that forms a toner pattern for color misregistration detection of each color on the intermediate transfer member, calculates a relative amount of misregistration from a difference in detection timing of the toner pattern of each color, and controls the exposure timing and the position of the optical system so that the misregistration is reduced.

The toner pattern for color toner pattern for misregistration detection is detected by an optical sensor arranged in the vicinity of the intermediate transfer member. The color misregistration correction control is performed based on the output from the optical sensor.

The optical sensor includes a sensor that detects diffused reflection light. In detecting a toner pattern for color misregistration detection by using a sensor that detects diffused reflection light, the sensor uses the difference in the level of output. The level of output which is obtained by detecting diffused reflection light reflected from a toner pattern of a chromatic color such as yellow, magenta, or cyan, and the level of output which is obtained by detecting diffused reflection light reflected from the intermediate transfer member are greatly different. Thus, the positional relation of each toner pattern of a chromatic color can be identified by receiving the diffused reflection light.

On the other hand, since toner of an achromatic color such as black toner absorbs light, the amount of light reflected from a toner pattern of an achromatic color is smaller than that reflected from a toner pattern of a chromatic color. Thus, the difference in the level of output of the diffused reflection light reflected from the intermediate transfer member and the level of output of a toner pattern of an achromatic color such as black is too small to be detected unless processing such as increasing the amount of emission is performed.

Thus, Japanese Patent Application Laid-Open No. 2007-156159 discusses a method that uses a combination toner pattern in detecting a position of a toner pattern formed by toner that reflects small amount of light such as black toner. The combination toner pattern includes a chromatic color toner pattern and an achromatic color toner pattern. The image forming apparatus discussed in Japanese Patent Application Laid-Open No. 2007-156159 identifies a position of an achromatic color toner pattern from an output waveform obtained from the combination toner pattern.

FIG. 13A illustrates a model of the toner patterns for color misregistration detection discussed in Japanese Patent Application Laid-Open No. 2007-156159. The detection toner patterns include a yellow toner pattern 1302*a*, a magenta toner pattern 1303*a*, a cyan toner pattern 1304*a*, and a combination toner pattern 1305*a*, and are formed on an intermediate transfer member 1301. The combination toner pattern 1305*a* is a black toner image formed over a portion of a magenta toner image.

A light-receiving unit that receives the light reflected from the toner patterns for color misregistration detection outputs an analog signal that includes outputs 1302*b*, 1303*b*, 1304*b*, 1305*b*1, and 1305*b*2 that correspond to each of the toner patterns (see FIG. 13B). Each output is converted into a binary digital signal according to a predetermined threshold value indicated by a dotted line in FIG. 13B. The digital signal includes outputs 1302*c*, 1303*c*, 1304*c*, 1305*c*1, and 1305*c*2 that correspond to the outputs 1302*b*, 1303*b*, 1304*b*, 1305*b*1, and 1305*b*2 (see FIG. 13C).

Further, a central processing unit (CPU) included in the image forming apparatus identifies, for example, the positions of the chromatic color toner patterns from barycentric positions of the outputs 1302*c*, 1303*c*, and 1304*c* included in the digital signal obtained from the chromatic color toner patterns. Further, regarding the combination toner pattern, the CPU acquires a barycentric position of the output 1305*c*1 and a barycentric position of the output 1305*c*2 included in the digital signal. Then, the CPU considers that the middle point of the two barycentric positions is the position of the black toner pattern.

Further, as a different method for identifying the position of the black toner pattern, an intersection point of the fall of the output 1305*b*1 of the analog signal and the threshold value, and an intersection point of the rise of the output 1305*b*2 and the threshold value are obtained. Then, the middle point of the intersection points can be considered as the position of the black toner pattern.

However, the method using a combination toner pattern such as the one discussed in Japanese Patent Application Laid-Open No. 2007-156159 is not convenient due to the following reasons. Although the positions of the chromatic color toner patterns are identified by using the outputs 1302*b*, 1303*b*, and 1304*b* included in the digital signal, the position of the achromatic color toner pattern (black toner pattern) is obtained by calculating the barycentric positions of the two outputs 1305C1 and 1305C2 included in the digital signal and further calculating the middle point of the two barycentric positions. Thus, in addition to the processing for identifying the position of the chromatic color toner pattern, the apparatus needs to perform processing for identifying the position of the achromatic color toner pattern. Thus, the design of the apparatus becomes complicated.

Further, regarding the other method for identifying the position of the black toner pattern, the intersection point of the rise of the output 1305*b*1 of the analog signal and the threshold value, and the intersection point of the fall of the output 1305*b*2 and the threshold value need to be excluded from the detection result. Thus, the design of the apparatus becomes complicated.

SUMMARY OF THE INVENTION

According to an aspect of the present invention, a color image forming apparatus includes an image bearing member that moves; a first image forming unit configured to form a chromatic color toner image on the image bearing member; a second image forming unit configured to form an achromatic color toner image on the image bearing member; a control unit configured to cause the first and second image forming units to form a first detection toner pattern having the achromatic toner image superposed upon the chromatic color toner image and to cause the first image forming unit to form a second detection toner pattern having the chromatic color toner image, wherein the first detection toner pattern is formed by superposing the achromatic toner images with a predetermined interval upon the chromatic color toner image so that the chromatic color toner image is exposed at the predetermined interval; an emission unit configured to emit light on the first detection toner pattern, the second detection toner pattern, or the image bearing member; a light-receiving unit configured to receive a light reflected from the first detection toner pattern, the second detection toner pattern, or the image bearing member, and generate a signal according to an amount of the received light; and a detection unit configured to identify a relative position of the chromatic color toner image and the achromatic color toner image on the image bearing member by detecting, based on the signal generated by the light-receiving unit, the relative position of the chromatic color toner image included in each of the first and the second detection toner patterns.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Dimensions, material, and shape of the components described below and their relative positions are not to be construed as limiting the scope of the present invention unless otherwise specified.

Figure 1:
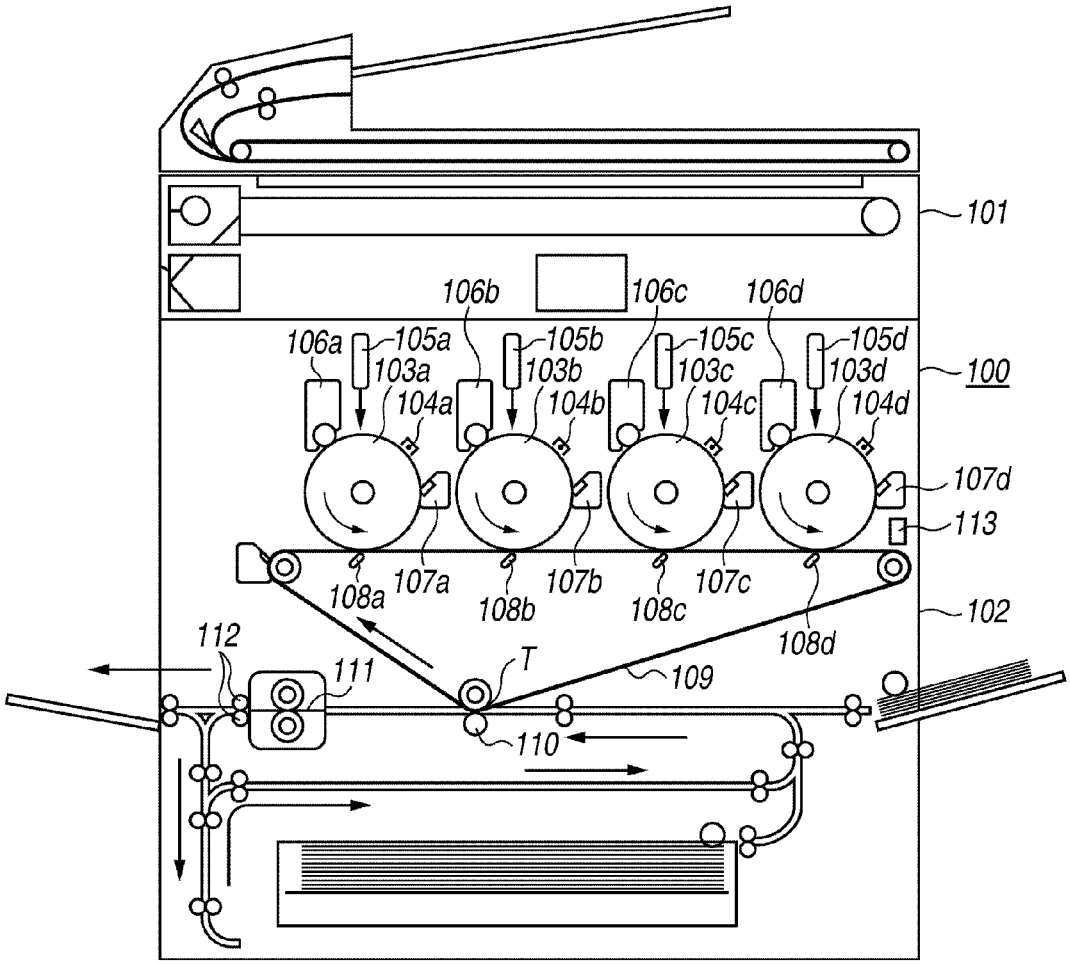
FIG. 1 is a cross-sectional view of an image forming apparatus according to an exemplary embodiment of the present invention.

FIG. 1 is a cross-sectional drawing of an overall configuration of an image forming apparatus 100 according to a first exemplary embodiment of the present invention and illustrates a schematic configuration of a full-color printer employing the electrophotography method. The image forming apparatus 100 illustrated in FIG. 1 includes a document reading unit 101 and an image forming unit 102. The document reading unit 101 reads an image of a document. The image forming unit 102 forms an image of the document on a recording medium based on the data obtained by the document reading unit 101.

The image forming unit 102 includes an image forming station Y used for forming an yellow (Y) toner image, an image forming station M used for forming a magenta (M) toner image, an image forming station C used for forming a cyan (C) toner image, and an image forming station Bk used for forming a black (Bk) toner image. The image forming station Y includes a photosensitive drum 103*a* (a photosensitive member), a charging unit 104*a* (a charging device of the photosensitive drum 103*a*), and a light scanning unit 105*a*. The light scanning unit 105*a* emits a light beam (laser beam) used for forming an electrostatic latent image on the photosensitive drum 103*a* which has been charged. The image forming station Y further includes a developing unit 106*a* used for developing the electrostatic latent image using toner and a cleaning unit 107*a* used for cleaning residual toner on the photosensitive drum 103*a*.

The configurations of other image forming stations are similar to the configuration of the image forming station Y. The image forming station M that forms magenta toner image includes a photosensitive drum 103*b* (a photosensitive member), a charging unit 104*b*, a light scanning unit 105*b*, a developing unit 106*b*, and a cleaning unit 107*b*. Further, the image forming station C that forms cyan toner image includes a photosensitive drum 103*c* (a photosensitive member), a charging unit 104*c*, a light scanning unit 105*c*, a developing unit 106*c*, and a cleaning unit 107*c*. Furthermore, the image forming station Bk that forms black toner image includes a photosensitive drum 103*d* (a photosensitive member), a charging unit 104*d*, a light scanning unit 105*d*, a developing unit 106*d*, and a cleaning unit 107*d*.

Next, image forming processing performed by each of the image forming stations will be described. Since the image forming processing performed by the image forming stations Y, M, C, and Bk is similar, the processing of the image forming station Y will be described and description of other image forming stations is not repeated. First, the photosensitive drum 103*a* is charged by the charging unit 104*a*. Then, an electrostatic latent image is formed on the charged photosensitive drum 103*a* by a laser beam (light beam) emitted from a laser light emitting unit (a light source). The light emitting unit is included in the light scanning unit 105*a*. After then, the electrostatic latent image is developed by the developing unit 106*a* using yellow toner.

The yellow toner image developed on the photosensitive drum 103*a* is transferred onto an intermediate transfer belt 109, which is an intermediate transfer member (image bearing member) according to a transfer bias applied to a transfer blade 108*a*.

Similarly, a magenta toner image on the photosensitive drum 103*b*, a cyan toner image on the photosensitive drum 103*c*, and a black toner image on the photosensitive drum 103*d* are transferred onto the intermediate transfer belt 109 (image bearing member) by a transfer blade 108*b*, a transfer blade 108*c*, and a transfer blade 108*d*, respectively. The toner images of four colors transferred onto the intermediate transfer belt 109 are transferred at once onto a recording medium S by a secondary transfer roller 110 at a secondary transfer unit T. After then, the recording medium S with the toner image is conveyed to a fixing unit 111 and the toner image is fixed. Then, the recording medium S with the fixed image is discharged by a discharge roller 112 to the outside of the apparatus.

The image forming station Bk is provided closer to the secondary transfer unit side in the rotation direction of the intermediate transfer belt 109 compared to the image forming stations of chromatic colors Y, M, and C. If a user gives an instruction to form a monochromatic image, this arrangement is helpful in reducing the time necessary in outputting the image.

As illustrated in FIG. 1, in the vicinity of the intermediate transfer belt 109, more particularly, between the image forming station Bk used for forming a black image and the secondary transfer roller 110, there is provided an optical sensor 113. The optical sensor 113 is used for detecting a toner pattern for color misregistration detection described below.

Figure 2:
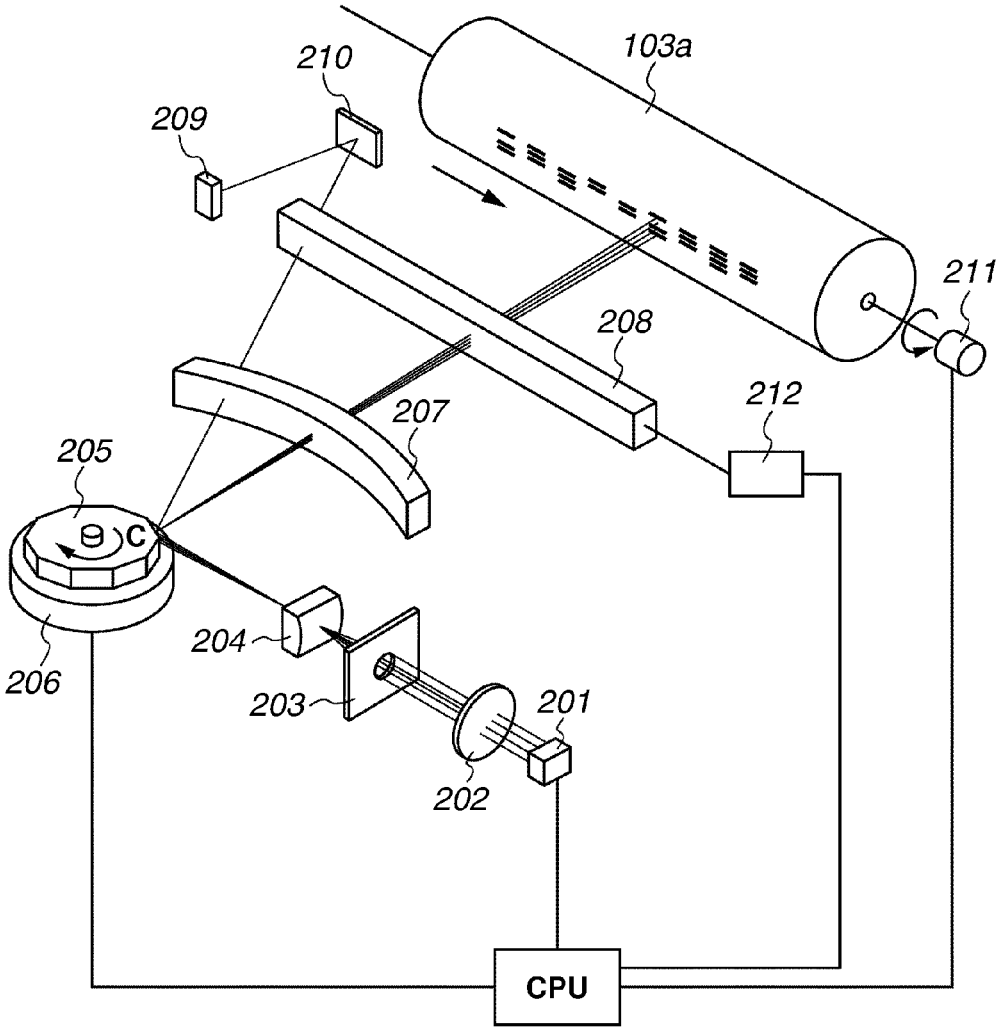
FIG. 2 is a schematic diagram of a light scanning unit and a photosensitive drum according to the exemplary embodiment.

FIG. 2 is a schematic diagram of an inner configuration of the light scanning unit 105*a* and the photosensitive drum 103*a*. Since the configurations of the light scanning units 105*a* to 105*d* are similar, the light scanning unit 105*a* will be described and descriptions of other light scanning units are not repeated. The light scanning unit 105*a* includes a semiconductor laser source 201 (alight source), a collimator lens 202, an aperture diaphragm 203, a cylindrical lens 204, a polygonal mirror 205, a polygonal mirror drive unit 206, a toric lens 207, and a diffractive optical element 208.

The collimator lens 202 converts a light beam emitted from the semiconductor laser source 201 into a parallel light flux. The aperture diaphragm 203 limits the passage of the light flux of the laser beam. The cylindrical lens 204 has a predetermined refractive power in one direction (the sub-scanning direction). The light flux that passed through the aperture diaphragm 203 is directed to a reflection surface of the polygonal mirror 205 at an oblique angle forming an elliptical image whose major axis is in the main scanning direction. The polygonal mirror 205 is driven by a polygonal mirror drive unit 206 and rotates at a constant speed in the direction indicated by the arrow C in FIG. 2. The polygonal mirror 205 performs deflection scanning using the laser beam on the reflection surface.

The toric lens 207 is an optical element having fθ characteristics. The toric lens 207 has different refractive indexes in the main scanning direction and in the sub-scanning direction. Both sides of the lens surface of the toric lens 207 in the main scanning direction have an aspheric shape. The diffractive optical element 208 is an optical element having fθ characteristics. The magnification of the diffractive optical element 208 is different in the main scanning direction and in the sub-scanning direction. A beam detector (BD) 209, which is a laser beam detecting unit, is provided at a position out of an image forming region of the photosensitive drum 103*a* included in the image forming apparatus 100. A scan timing signal (BD signal) is generated when a laser beam reflected from a reflection mirror 210 is detected.

A spot of a laser beam emitted from the semiconductor laser source 201 and deflected by the polygonal mirror 205 moves (scans) linearly on the photosensitive drum 103*a* in parallel with the axis of the photosensitive drum. The semiconductor laser source 201 in the light scanning unit 105*a* according to the present embodiment emits a multibeam laser. Thus, an electrostatic latent image of multiple lines is formed in one scanning. The photosensitive drum 103*a* rotates about the axis by a drive of a drum drive unit 211. Since the main scanning is performed back and forth, an image is written in the sub-scanning direction (rotation direction of the photosensitive drum).

The diffractive optical element 208 is rotatable about an axis parallel to the optical axis. By the rotation of the diffractive optical element 208 about this axis, the inclination of the scanning line on the photosensitive drum 103*a* (the inclination of the scanning line with respect to the axis of rotation of the photosensitive drum 103*a*) can be corrected. Further, the diffractive optical element 208 is rotatable about an axis parallel to the longitudinal direction of the diffractive optical element 208. By the rotation of the diffractive optical element 208 about this axis, the curve of the scanning line on the photosensitive drum 103*a* can be corrected. The diffractive optical element 208 rotates according to the drive of a diffractive optical element drive unit 212.

The semiconductor laser source 201, the polygonal mirror drive unit 206, the drum drive unit 211, and the diffractive optical element drive unit 212 are controlled by a CPU described below.

After the surface of the photosensitive drum 103*a* is charged by the charging unit 104*a*, exposure of the surface of the photosensitive drum 103*a* by the laser beam is performed.

Electric potential of the surface of the photosensitive drum 103*a* is changed according to the intensity of the laser light directed onto the surface.

Next, relative misregistration (color misregistration) between the toner images of different colors transferred onto the intermediate transfer belt 109 by each of the image forming stations will be described. As described above, yellow, magenta, cyan, and black toner images are formed on the photosensitive drums 103*a* to 103*d*, respectively. By transferring each toner image formed on each of the photosensitive drums onto a recording medium, a color image is formed on the recording medium. If misregistration of the toner images formed on the photosensitive drums occurs, the image quality of the obtained image will be reduced. This is because the tint of the output image will be different from that of the document image.

Thus, the image forming apparatus 100 forms a toner pattern for color misregistration detection on the intermediate transfer belt 109 in certain timing by using toner of each color. The timing is, for example, when the power of the image forming apparatus 100 is turned on, when the apparatus returns from standby, or when the image is formed on a predetermined number (cumulative number) of recording media. Then, based on the detection result of the toner pattern for color misregistration detection, the control for correcting the relative misregistration of the toner image of each color is performed.

Figure 3:
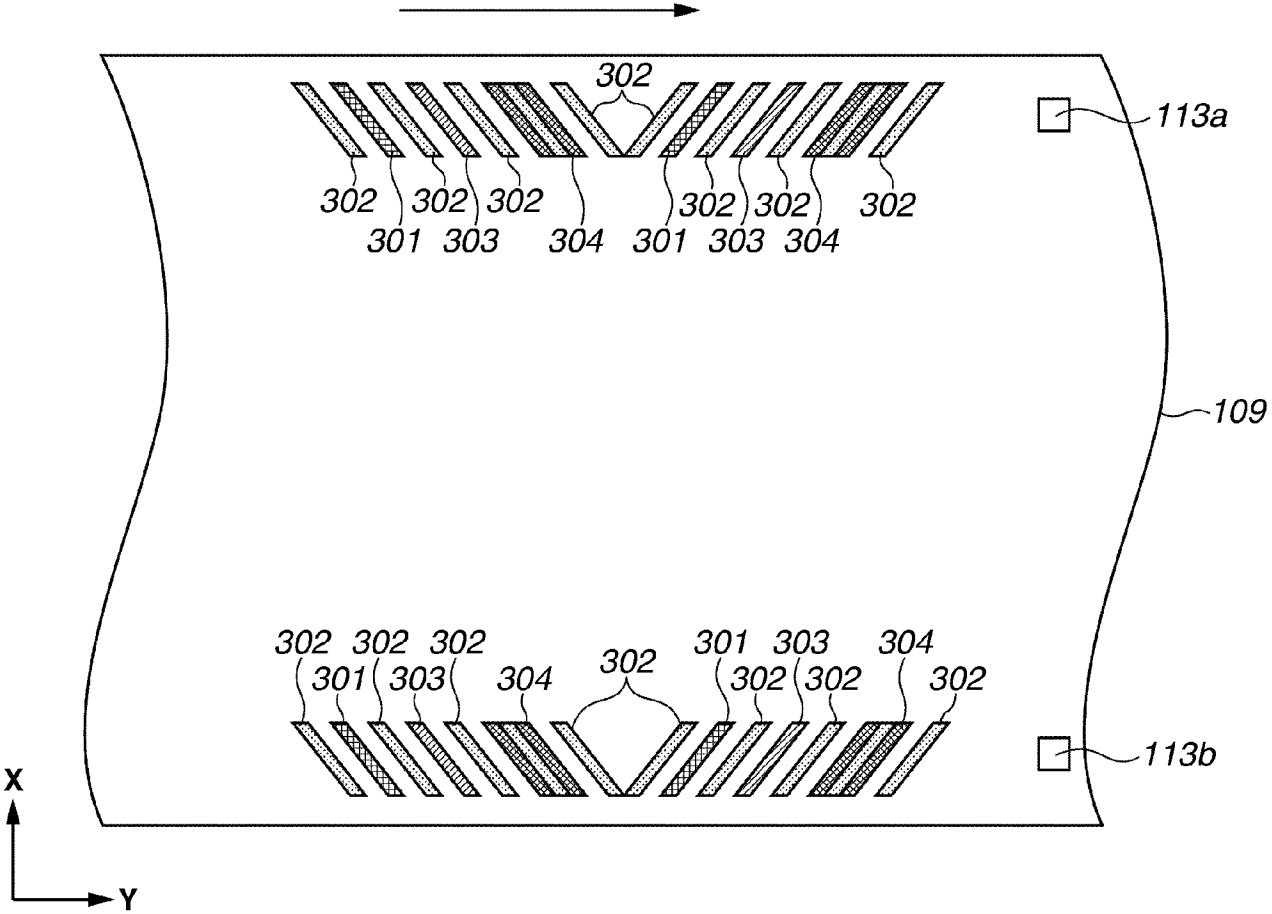
FIG. 3 is a schematic diagram of a toner pattern for color misregistration detection formed on an intermediate transfer belt.

FIG. 3 is a schematic diagram of the toner pattern for color misregistration detection formed by the intermediate transfer belt 109. FIG. 3 illustrates a yellow toner pattern 301, a magenta toner pattern 302, and a cyan toner pattern 303 transferred onto the intermediate transfer belt 109 from photosensitive drums corresponding to each color. These toner patterns are second detection toner patterns. Further, in addition to the above-described independent toner patterns of chromatic colors, a combination toner pattern 304 (first detection toner pattern) is formed by the image forming apparatus 100 according to the present embodiment. The combination toner pattern 304 is used for identifying a formation position of a black toner image and is formed in such a manner that at least some black toner is superposed on the magenta toner image. Detailed descriptions of the combination toner pattern 304 will be given below.

Further, in the following description, the yellow toner pattern 301, the magenta toner pattern 302, the cyan toner pattern 303, and the combination toner pattern 304 are collectively referred to as a toner pattern for color misregistration detection in the following description.

The X-axis direction in FIG. 3 is the direction of the rotational axis of the photosensitive drum (the main scanning direction). The intermediate transfer belt 109 is conveyed in the Y-axis direction (sub-scanning direction), which is a direction perpendicular to the X-axis direction, indicated by an arrow. For example, the toner pattern for color misregistration detection is formed at two positions in the main scanning direction. In FIG. 3, optical sensors 113*a* and 113*b* are provided as the optical sensor 113. As illustrated in FIG. 3, the optical sensors 113*a* and 113*b* are provided at positions appropriate for the detection of the color toner patterns for misregistration detection which are formed at different positions in the main scanning direction.

According to the present embodiment, the position of the magenta toner pattern 302 is set at the reference position. Then, relative positions of the toner patterns of other colors including black are obtained and the relative amount of misregistration is calculated from the obtained relative positions. Thus, the image forming apparatus 100 according to the present embodiment can perform correction control by using the relative amount of misregistration so that misregistration of the toner images does not occur when an image is formed based on the input image data.

Figure 4:
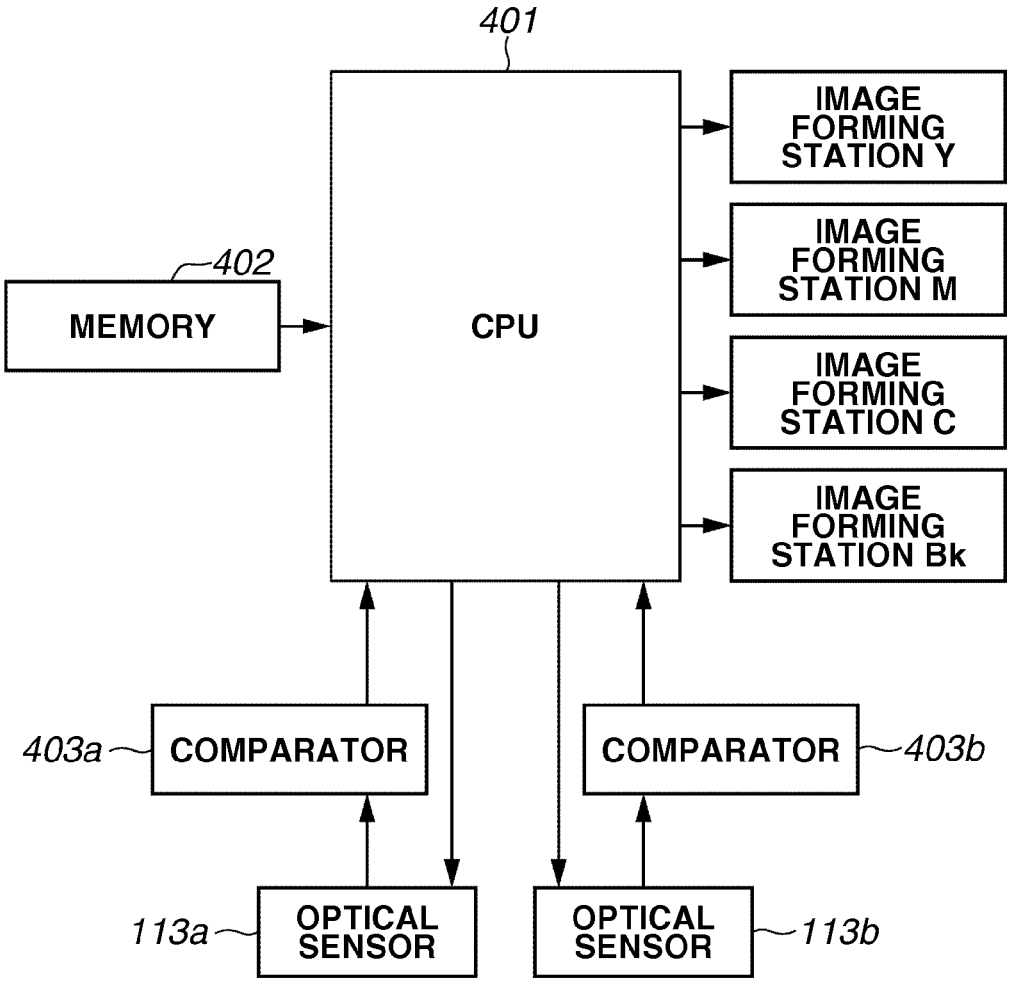
FIG. 4 is a control block diagram of the image forming apparatus according to the exemplary embodiment.

FIG. 4 is a block diagram of the image forming apparatus of the present embodiment regarding the units used for executing the color misregistration correction control. The color misregistration correction control is executed by a CPU 401. Control flow of the processing used for controlling the color misregistration correction is stored in a memory 402. An analog signal output from the optical sensor 113*a* is input in a comparator 403*a* and converted into a digital signal (described in detail below). Similarly, an analog signal output from the optical sensor 113*b* is input in a comparator 403*b* and converted into a digital signal. In the description below, the optical sensors 113*a* and 113*b* are expressed as the optical sensor 113 and the comparators 403*a* and 403*b* are described as a comparator 403 in order to simplify the description A digital signal output from the comparator 403 is input into the CPU 401. Based on the digital signal which has been input, the CPU 401 detects a relative position of the toner pattern of each color. Then, by using the obtained result, the CPU 401 calculates a relative amount of misregistration of the toner pattern of each color. Then, the CPU 401 corrects the color misregistration based on the amount of misregistration. A signal used for correcting the color misregistration is transmitted from the CPU 401 to the image forming stations Y, M, C, and Bk.

Figure 5:
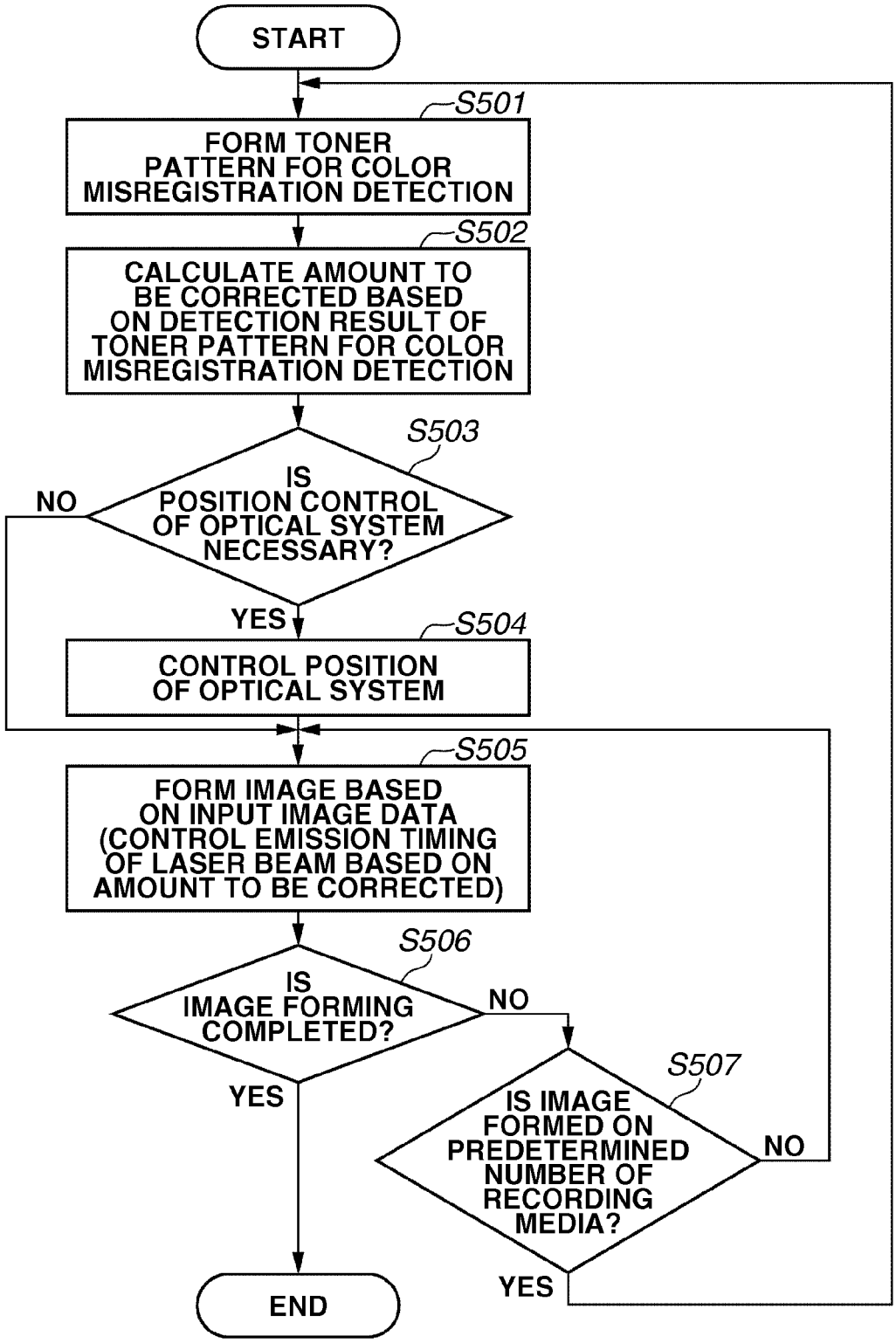
FIG. 5 is a flowchart illustrating color misregistration correction control executed by the image forming apparatus according to the present embodiment.

FIG. 5 is a flowchart illustrating the color misregistration correction control executed by the CPU 401. The toner pattern for color misregistration detection is formed, for example, when the power of the image forming apparatus is turned on, image data is sent from a reading unit or an external information apparatus, when the image forming apparatus is at standby, or when the cumulative count of images formed on the recording media reaches a predetermined count while the image forming is continuously performed. The flowchart in FIG. 5 is realized by the control processing executed by the CPU 401. The control processing starts when image data is input in the image forming apparatus at a standby state and ends when the image forming is completed.

In step S501, if image data is input from the reading unit or the external information apparatus, the CPU 401 instructs each of the image forming stations to form the toner pattern for color misregistration detection. In step S502, the CPU 401 calculates the amount to be corrected based on the result of the detection performed by the optical sensor 113 that detected the toner pattern for color misregistration detection.

In step S503, the CPU 401 determines whether it is necessary to control (change) the position of an optical system, such as a lens or a reflection mirror, in the light scanning unit. According to the present embodiment, the optical system is the diffractive optical element 208. In step S503, if the CPU 401 determines that the position of the optical system needs to be changed (YES in step S503), the processing proceeds to step S504. In step S504, the CPU 401 changes the position of the optical system. When the position control is completed, the processing proceeds to step S505. In step S505, the CPU 401 instructs each of the image forming stations to form an image based on the amount of correction calculated in step S502.

In step S503, if the CPU 401 determines that the position change of the optical system is not necessary (NO in step S503), then the processing proceeds to step S505. In step S506, the CPU 401 determines whether image formation based on all the image data is completed each time the image formation of one recording medium is performed. If the image formation based on all the image data is completed (YES in step S506), then the processing ends.

In step S506, if the CPU 401 determines that the image formation based on all the image data is not yet completed (NO in step S506), then the processing proceeds to step S507. In step S507, the CPU 401 determines whether the cumulative count of the images formed on the recording media has reached a predetermined count. In step S507, if the cumulative count of the images has reached the predetermined count (YES in step S507), then the processing returns to step S501. On the other hand, if the cumulative count of the images has not reached the predetermined count (NO in step S507), the processing returns to step S505.

Detection methods of the optical sensor 113 used for detecting the toner pattern for color misregistration detection include a method that uses specular reflection and a method that uses diffused reflection light. The method using diffused reflection light is used for the image forming apparatus of the present embodiment.

The gloss of the surface of the intermediate transfer belt 109 of the image forming apparatus is reduced over time as the toner and the cleaning unit affect the surface. If the detection method using specular reflection is used with respect to the optical sensor 113, the surface of the intermediate transfer belt 109 is susceptible to the change of the surface state. Thus, it is necessary to perform correction control such as controlling the amount of light emission or adjusting the density of the toner pattern in order to maintain the detection accuracy. If the detection method using diffused reflection light is used, the number of times the correction control is performed can be reduced.

Figure 6:
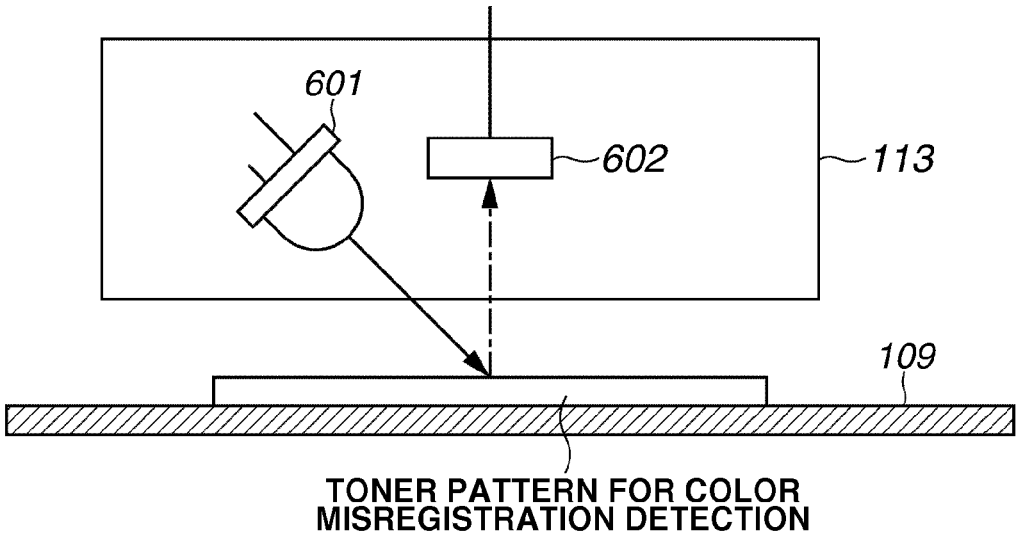
FIG. 6 is a schematic diagram of an optical sensor used in the image forming apparatus according to the present embodiment.

FIG. 6 is a schematic diagram of the optical sensor 113. The optical sensor 113 includes a light emitting unit 601 used for directing (projecting) light onto the intermediate transfer belt 109 or the toner pattern for color misregistration detection, and a light-receiving unit 602 used for receiving the light reflected from the intermediate transfer belt 109 or the toner pattern for color misregistration detection. The light-receiving unit 602 is arranged at such a position that the angle of incidence is not equal to the angle of reflection. According to this arrangement, the diffused reflection light of the light directed from the light emitting unit 601 onto the intermediate transfer belt 109 is received by the light-receiving unit 602.

Figure 7:
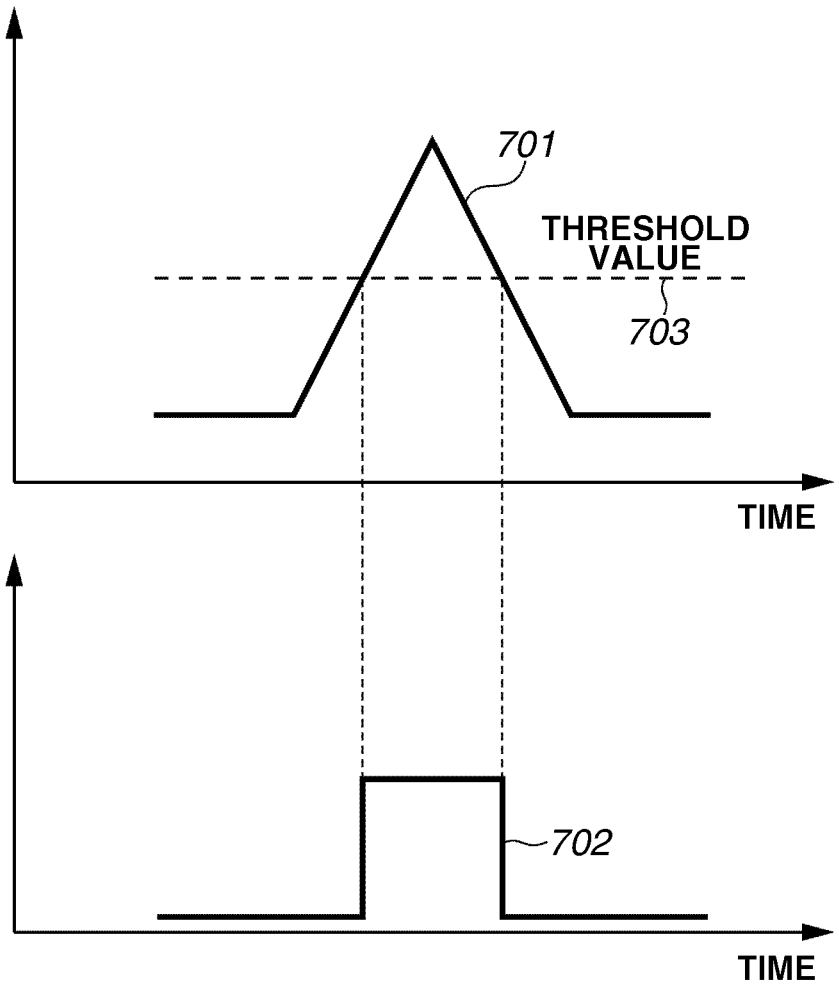
FIG. 7 illustrates a waveform of an analog signal output from the optical sensor and a waveform of a digital signal generated from the analog signal.

FIG. 7 illustrates an analog signal 701 and a digital signal 702. The analog signal 701 (detected signal) is obtained by the optical sensor 113 detecting the toner pattern for color misregistration detection. The digital signal 702 is generated from the analog signal 701. Since the surface of the intermediate transfer belt 109 is glossy, the quantity of light reflected from the surface of the intermediate transfer belt 109 by specular reflection is higher than the quantity of light reflected from the surface of the toner pattern of a chromatic color. Since constant light is emitted from the light emitting unit 601, the quantity of light reflected from the surface of the intermediate transfer belt 109 by diffused reflection is smaller than the quantity of light reflected from the toner pattern of a chromatic color by diffused reflection. Thus, the waveform of the analog signal 701 obtained by detecting the toner pattern of a chromatic color includes a spike waveform as illustrated in FIG. 7.

Although the waveform of the analog signal 701 in FIG. 7 is triangular, actually, the waveform is not always triangular. Since the waveform is dependent on the width of the toner pattern in the rotation direction (drive direction) of the intermediate transfer belt 109 and the width of the light-receiving unit 602 of the optical sensor 113, a trapezoidal waveform may be obtained depending on the relation of the widths.

The digital signal 702 is obtained by binarizing the analog signal 701 output from the light-receiving unit 602. The comparator 403 outputs a digital signal of "Hi" level if an analog signal with an output level that is equal to or greater than a threshold value 703 is input and outputs a digital signal of "Low" level if an analog signal with an output level that is smaller than the threshold value 703 is input.

If the method using diffused reflection detection is used for the detection of the toner pattern for color misregistration detection, since the black toner absorbs light, the amount of light of the diffused reflection light will be small. Thus, when a black toner pattern is detected by the optical sensor 113, the difference between the output signal level of the light reflected from the black toner pattern by diffused reflection and the output signal level of the light reflected from the intermediate transfer belt 109 by diffused reflection will be small. Thus, the detection method using diffused reflection light is not an optimum method in detecting a black toner pattern.

Thus, the image forming apparatus of the present embodiment uses the combination toner pattern 304 illustrated in FIG. 3. As described above, the combination toner pattern 304 includes a black toner pattern and a chromatic color toner pattern. The CPU 401 uses the waveform of the output signal obtained from the combination toner pattern in detecting the position where the black toner image is formed.

Figure 8:
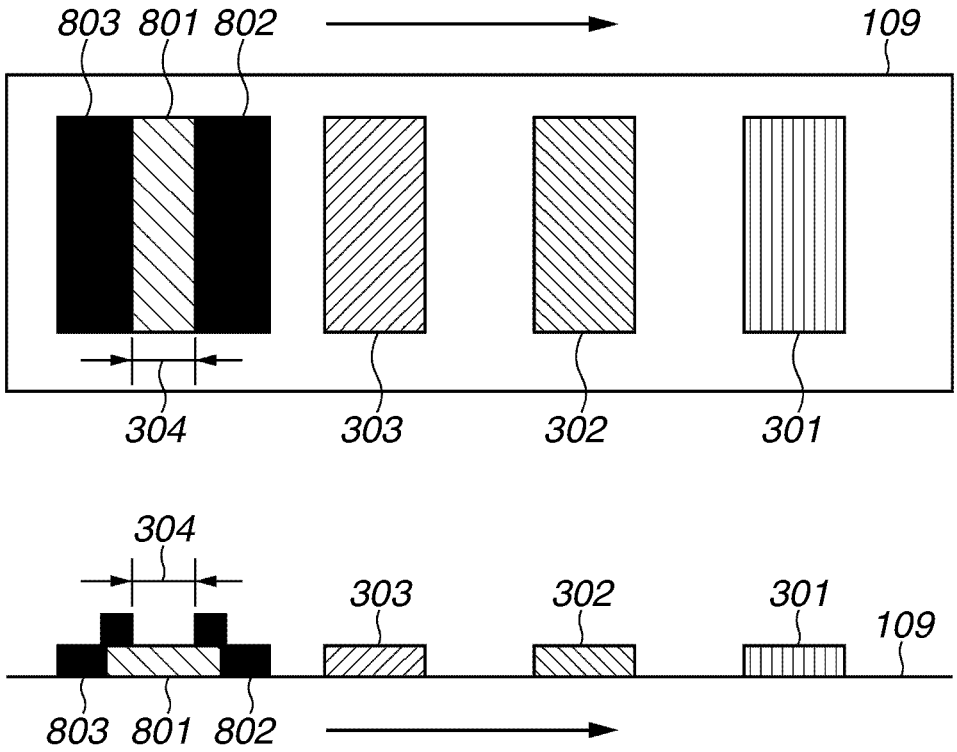
FIG. 8 illustrates a model of a combination toner pattern.

Next, the combination toner pattern 304 will be described with reference to FIG. 8. In order to simplify the description, a modeled version of the combination toner pattern 304 illustrated in FIG. 3 is illustrated in FIG. 8. The combination toner pattern 304 is formed by the image forming station M (first image forming unit) that forms a magenta toner image and the image forming station Bk (second image forming unit) that forms a black toner image.

As illustrated in FIG. 8, the combination toner pattern 304 includes a magenta toner image (first toner image) and a second and a third toner images which are black toner images. At least a part of the second toner image and the third toner image are superposed on the first toner image in the drive direction (moving direction) of the intermediate transfer belt 109. And, the second toner image and the third toner image are formed at a regular interval (a predetermined interval) in the drive direction of the intermediate transfer belt 109. The magenta toner image is exposed at the interval. Further, to be more precise, a second toner image 802 (black image) is formed over an end of a first toner image 801 (magenta image) in the conveying direction of the intermediate transfer belt 109. Further, a third toner image 803 (black image) is formed over the opposite end of the first toner image 801 in the conveying direction of the intermediate transfer belt 109.

The second toner image 802 and the third toner image 803 are formed with a predetermined space (the predetermined interval) in between in the conveying direction of the intermediate transfer belt 109 so that they are not joined at least on the first toner image 801. In other words, the second toner image 802 and the third toner image 803 are formed at both ends of the first toner image 801 in the conveying direction of the intermediate transfer belt 109 (image bearing member moving direction).

Figure 9A:
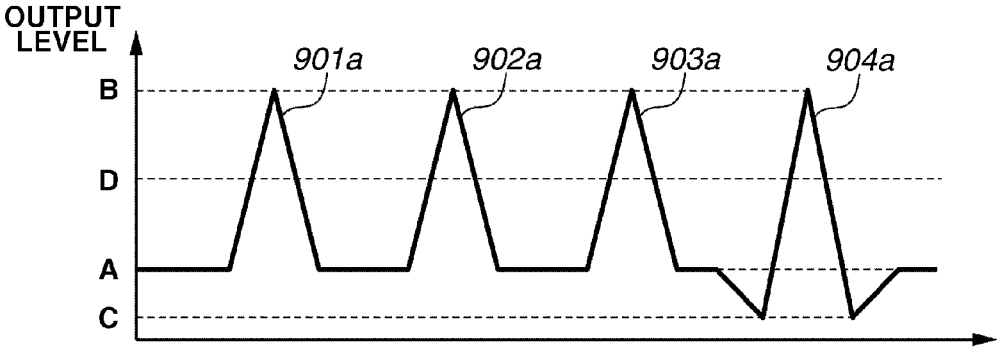
FIGS. 9A and 9B illustrate a waveform of an analog signal obtained from detection of the combination toner pattern and a waveform of a digital signal generated from the analog signal.

FIG. 9A illustrates a waveform of an output signal (analog signal) obtained from the toner pattern for color misregistration detection. If the light-receiving unit 602 of the optical sensor 113 receives a diffused reflection light reflected from the intermediate transfer belt 109, a signal of level A is output from the light-receiving unit 602. Further, if the light-receiving unit 602 receives diffused reflection lights reflected from the yellow toner pattern, the magenta toner pattern, and the cyan toner pattern, the level of the signals output from the light-receiving unit 602 will be increased to level B (outputs 901*a*, 902*a*, and 903*a* in FIG. 9A).

The density of the toner pattern of each color is adjusted so that the level of the signal output from the light-receiving unit 602 according to the detection of the toner pattern of each color is increased to level B. When the CPU 401 executes the density adjustment, the CPU 401 forms a toner pattern for density adjustment of each color, and based on the detection result of the density of the toner pattern for density adjustment of each color, the CPU 401 controls each of the image forming stations so that the density of the toner pattern of each color included in the detection toner pattern has a predetermined density.

Next, an output 904*a* of an analog signal obtained from the combination toner pattern 304 will be described in detail. First, since the light-receiving unit 602 receives the diffused reflection light reflected from the intermediate transfer belt 109, a signal of level A is output. Next, the second toner image 802 is conveyed to the detection position. Accordingly, the quantity of the diffused reflection light incident on the light-receiving unit 602 is changed and the level of output signal is also changed.

Next, since the quantity of the diffused reflection light reflected from the second toner image 802 is smaller than the quantity of the diffused reflection light reflected from the intermediate transfer belt 109, the level of the output signal is gradually decreased according to the detection of the second toner image 802 (black image). The level of the output signal is decreased until it reaches level C just before the first toner image 801 (magenta image) is conveyed to the detection position.

When the first toner image 801 (magenta image) is conveyed to the detection position, the second toner image 802 (black image) goes out of the detection position and conveyed toward the downstream of the conveying direction. As a result, the quantity of the diffused reflection light incident on the light-receiving unit 602 gradually increases until it finally reaches level B. After then, the third toner image 803 (black image) is conveyed to the detection position and the first toner image 801 (magenta image) will then be out of the detection position. Thus, the quantity of the diffused reflection light incident on the light-receiving unit 602 gradually decreases until it finally reaches level C. After then, since the third toner image 803 goes out of the detection position and conveyed toward the downstream of the conveying direction, the quantity of the diffused reflection light incident on the light-receiving unit 602 gradually increases. When the light incident on the light-receiving unit 602 is only the diffused reflection light reflected from the intermediate transfer belt 109, the output level returns to level A.

As described above, since the positions of the black toner images are identified by using the output waveform generated by the first toner image (magenta image), the combination toner pattern 304 is formed so that the second and the third toner images (black images) are formed with a predetermined space in between and the first toner image (magenta image) is exposed from that space between the second and the third toner images. According to an output waveform generated from the light reflected from the magenta toner image (the first toner image) included in the combination toner pattern 304, the position of the black toner images can be indirectly identified.

Figure 9B:
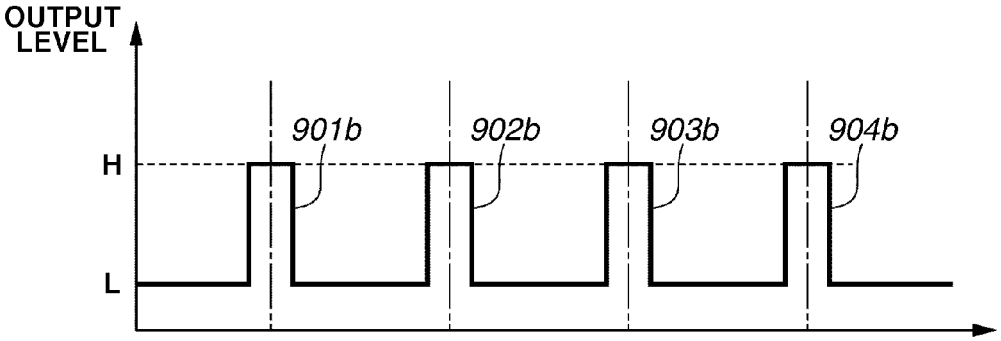

According to the change in the signal level as described above, an output waveform of an analog signal, such as the one illustrated in FIG. 9A, is obtained. The analog signal output from the light-receiving unit 602 is input in the comparator 403 and converted into a digital signal based on a threshold value set to level D (see FIG. 9B). Level D is lower than level B but higher than level A. If level C is higher than level A, level D will be set to a level higher than level C.

The digital signal includes outputs 901*b*, 902*b*, 903*b*, and 904*b* corresponding to outputs 901*a*, 902*a*, 903*a*, and 904*a* included in the analog signal. The CPU 401 compares the difference in the barycentric position of the digital signal and a barycentric position of a digital signal obtained by detecting a toner pattern of a reference color (magenta according to the present embodiment) with the reference value stored in the memory 402. The reference value is a difference in timing of the output generated according to the detection of a toner pattern of a reference color and the output generated according to the detection of a toner pattern of a non-reference color when the color misregistration is not generated.

The CPU 401 calculates the difference in output timing of the digital signal obtained from a toner pattern formed by using only the reference color (magenta) and the digital signal obtained from the combination toner pattern 304. Then, based on a comparison result of the difference and a predetermined value, the CPU 401 executes the color misregistration correction control. The CPU 401 performs the control by, for example, controlling the position of the optical lens so that the amount of misregistration is corrected before the image forming is performed or controlling the emission timing of the laser beam which is emitted when the image forming is performed.

Figure 10:
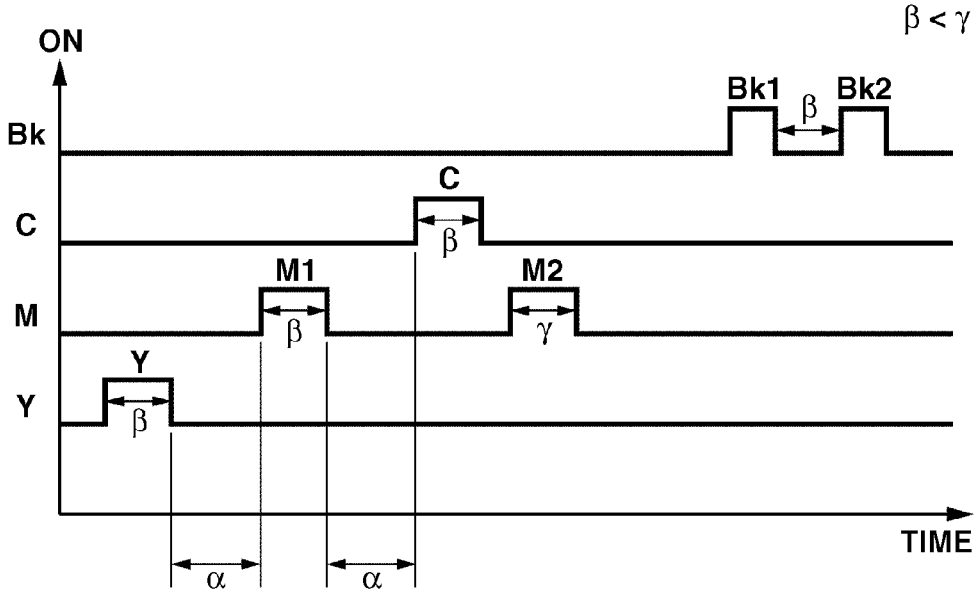
FIG. 10 is an output timing chart of an image signal output to each image forming station corresponding to each color according to an instruction given by a CPU when the toner pattern for misregistration detection is formed.

FIG. 10 is a timing chart illustrating the timing the image signal, which is used when a pattern of each color is formed, is sent to each of the image forming stations Y, M, C, and Bk. The image forming apparatus according to the present embodiment forms the toner patterns in the order of yellow, magenta, cyan, and the combination toner pattern (including black and magenta toner patterns) from the downstream to the upstream of the conveying direction of the intermediate transfer belt 109 as illustrated in FIG. 1.

The CPU 401 transmits an image signal used for forming each toner pattern to each image forming station. The image signal is transmitted in timing which is set in consideration of the conveying speed of the intermediate transfer belt 109. First, the CPU 401 transmits an image signal Y used for forming a yellow toner pattern to the image forming station Y. After then, the CPU 401 transmits an image signal M1 to the image forming station M used for forming a magenta toner pattern on the upstream side of the conveying direction of the intermediate transfer belt 109 of the yellow toner pattern in timing of time a delay after the image signal Y is transmitted.

Similarly, the CPU 401 transmits an image signal C to the image forming station C used for forming a cyan toner pattern on the upstream side of the conveying direction of the intermediate transfer belt 109 of the magenta toner pattern in timing of time a delay after the image signal M is transmitted. The output period of the image signals Y, M1, and C is set to an output period β. The output period β is determined so that the widths of the toner patterns which are formed according to the image signals Y, M1, and C are equal to a predetermined width (e.g., β'). Accordingly, the toner pattern formed according to each signal will have a same width in the conveying direction of the intermediate transfer belt 109.

Further, the semiconductor laser of each image forming station is controlled so that the output levels of the analog signal obtained by the detection of the chromatic color toner patterns are equal. In other words, the exposure area per unit area or the light quantity (light intensity) is controlled. In this manner, variance in the detection accuracy of the positions of the chromatic color toner patterns will not occur.

After then, the CPU 401 transmits an image signal M2 to the image forming station M in timing the combination toner pattern 304 is formed upstream of the cyan toner pattern in the conveying direction of the intermediate transfer belt 109, and transmits image signals Bk1 and Bk2 to the image forming station Bk. The image signal Bk2 is transmitted from the CPU 401 to the image forming station Bk in timing of a predetermined period of time delay after the image signal Bk1 is transmitted to the image forming station Bk so that the difference in the timing of the fall of the image signal Bk1 and the timing of the rise of the image signal Bk2 is β (the space between the second toner image 802 and the third toner image is β'). The output period of the image signal M2 will be described below.

The output timing of the image signals Bk1 and Bk2 is set according to the output timing of the image signal M2 so that the black toner pattern which is formed according to the image signal Bk1 is superposed upstream and the black toner pattern which is formed according to the image signal Bk2 is superposed downstream of the intermediate transfer belt 109 in the rotation direction on the magenta toner pattern which has been formed according to the image signal M2. Thus, the output timing of the image signal Bk1 is a predetermined period of time after the output timing of the image signal M2 elapses.

Further, the output timing of the image signal Bk2 is set according to the image signal Bk1 so that the difference in timing β between the fall timing of the image signal Bk1 and the rise timing of the image signal Bk2 is smaller than an output period γ of the image signal M2. In this manner, the combination toner pattern 304 including the second toner image 802 (black) formed upstream and the third toner image 803 (black) formed downstream on the first toner image 801 (magenta) is obtained.

If the image forming apparatus is a type of apparatus that corrects the color misregistration by using the combination toner pattern 304, the following problem may occur. The rotating speed of a developing sleeve that carries the toner and the rotating speed of the photosensitive member are determined so that there is a certain difference in the speeds. The speed difference is effective in increasing the development capability of the toner when the electrostatic latent image formed on the photosensitive drum is developed. If the speeds are different, the density level of the toner image developed on the photosensitive drum at the rear end in the rotation direction will be lower compared to the density level of the toner image formed upstream or in the middle portions of the photosensitive drum.

Figure 11A:
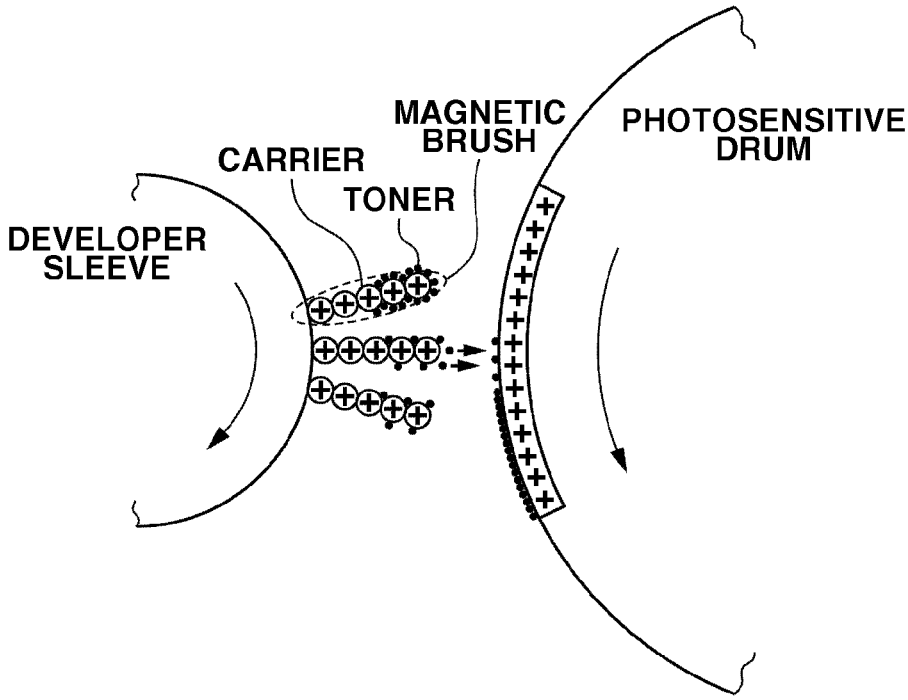
FIGS. 11A and 11B are cross-sectional views of a developing sleeve and the photosensitive drum with a density-reduced region.

As illustrated in FIG. 11A, a brush-like carrier called a magnetic brush is formed on the developing sleeve. Toner with polarity opposite to the carrier is attached to the magnetic brush. If the rotating speed of the photosensitive drum and the rotating speed of the developing sleeve are equal, the amount of the toner attached to the magnetic brush may be smaller than the amount of toner that is necessary in developing the electrostatic latent image.

If the rotating speed of the developing sleeve is faster than the rotating speed of the photosensitive drum, the amount of toner supplied to the gap between the photosensitive drum and the developing sleeve is increased compared to a case where the rotating speeds are equal. Thus, since the shortage of toner does not occur if the rotating speed of the developing sleeve is set to a speed faster than the rotating speed of the photosensitive drum, image density is not reduced even if a highly-dense image is formed.

Figure 11B:
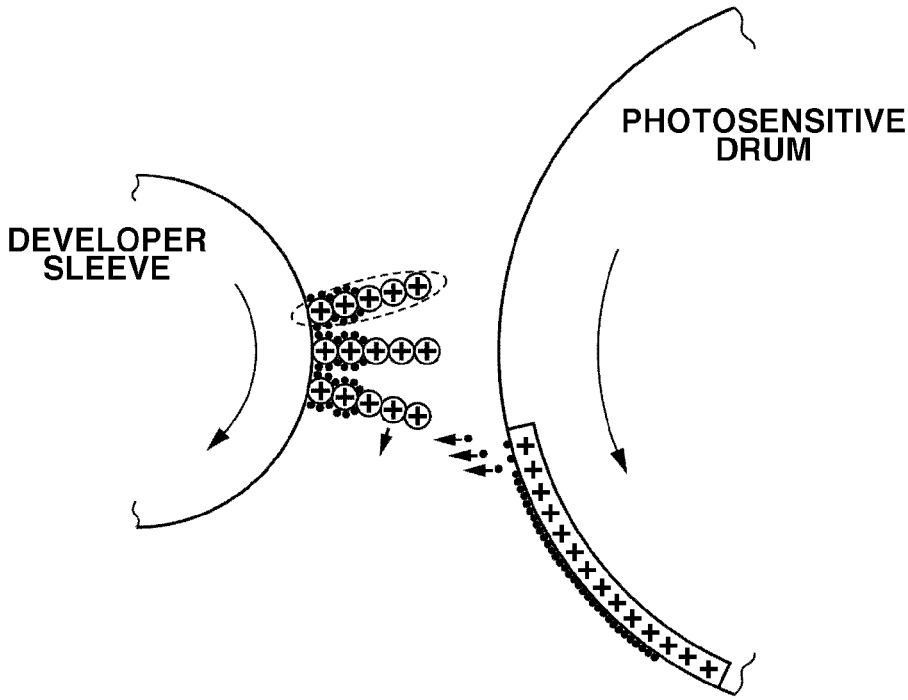

Next, the density-reduced region will be described with reference to FIGS. 11A and 11B. In order to simplify the description below, the carrier has an electrostatic charge, the toner charged by the carrier has a negative charge, and the electrostatic latent image has a positive charge as it is exposed to the light beam. When the magnetic brush comes close to the photosensitive drum, the toner attached to the magnetic brush is attracted to the electrostatic latent image on the photosensitive drum and the electrostatic latent image is developed by the toner (see FIG. 11A).

If a positively-charged region on the photosensitive member continuously passes the gap between the photosensitive drum and the developing sleeve, since the toner, which has a negative charge, is attracted to the electrostatic latent image, the toner is attached to the tip of the magnetic brush (see FIG. 11A). Thus, the carrier at the tip of the magnetic brush is not exposed.

On the other hand, there is a boundary region between the exposure potential region having a positive charge and a charge potential region having a negative charge at the trailing edge side of the electrostatic latent image in the moving direction of the photosensitive member. Since the charge region has a negative charge, when the charge potential region comes closer to the magnetic brush following the exposure potential region, the toner attached to the magnetic brush is moved in the direction away from the photosensitive drum (see FIG. 11B). Accordingly, the carrier at the tip of the magnetic brush in a close range of the trailing edge of the image will be exposed. Since the rotating speed of the developing sleeve is faster than the rotating speed of the photosensitive drum, magnetic brushes with an exposed tip successively come close to the trailing edge of the electrostatic latent image. Thus, the toner on the trailing edge of the image formed on the photosensitive drum is attracted again by the exposed carrier, and the density of the trailing edge of the image will be lower compared to the predetermined density (see FIG. 11B).

This phenomenon also occurs when the toner pattern for color misregistration detection is formed. Since the density-reduced region is very small, the region is almost unrecognizable. Further, the amount of reduction is also small. Thus the density reduction does not affect the image quality of the image formed on the recording medium.

Figure 12A:
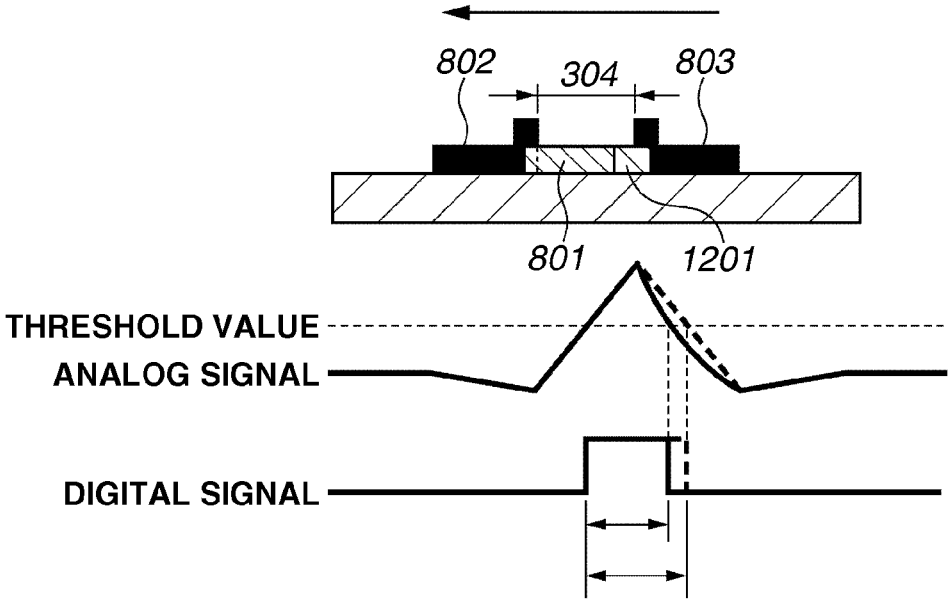
FIGS. 12A and 12B illustrate cross sections of the combination toner pattern.

However, if such a density-reduced region is generated at the trailing edge of the toner pattern for color misregistration detection, since the fall of the output waveform starts in earlier timing, the detection accuracy of the barycentric position of the output waveform will be reduced. FIG. 12A illustrates a case where the third toner image 803 is not formed on a density-reduced region 1201 of the first toner image 801 (background toner image). The conveying direction of the intermediate transfer belt is indicated by an arrow. Since the amount of diffused reflection light is reduced according to the reduction of the density of the pattern, the sensor output of the light-receiving unit 602 is reduced.

Thus, when the first toner image 801 is detected, according to the reduction of the amount of the diffused reflection light reflected from the density-reduced region 1201 of the first toner image 801, as illustrated in FIG. 12, the waveform of the falling portion of the pattern will be different from the desired waveform (indicated by the dotted line) which is obtained when the density of the first toner image 801 is constant. If the binarized signal is output using the threshold value from the output waveform as described above, the position of the black toner pattern cannot be accurately detected. As a result, the detection accuracy is reduced and the color misregistration cannot be accurately corrected.

Since the chromatic color toner pattern consists of a single color, the appearance of the density-reduced region 1201 described above can be reduced by increasing the density of the toner pattern. On the other hand, regarding the case of the combination toner pattern 304, if the density of the toner pattern for color misregistration detection is increased so as to prevent the appearance of the density-reduced region 1201, since the amount of toner at the region where the achromatic toner pattern is formed over the chromatic toner pattern increases, it will overload the cleaning unit. If the load on the cleaning unit is increased, the cleaning performance is reduced. This results in reduced image quality.

Thus, according to the image forming apparatus of the present embodiment, in forming the combination toner pattern 304, the image signal M2 is output when the third toner image 803 (black image) is superposed on the density-reduced region 1201 of the first toner image 801 (magenta image). The width of the density-reduced region 1201 in the conveying direction of the intermediate transfer belt 109 is measured when the image forming apparatus is assembled. The output period of the image signal M2 transmitted from the CPU 401 to the image forming station M is set based on the measurement result so that a combination toner pattern having the density-reduced region 1201 of the first toner image 801 covered with the third toner image 803 is formed.

Figure 12B:
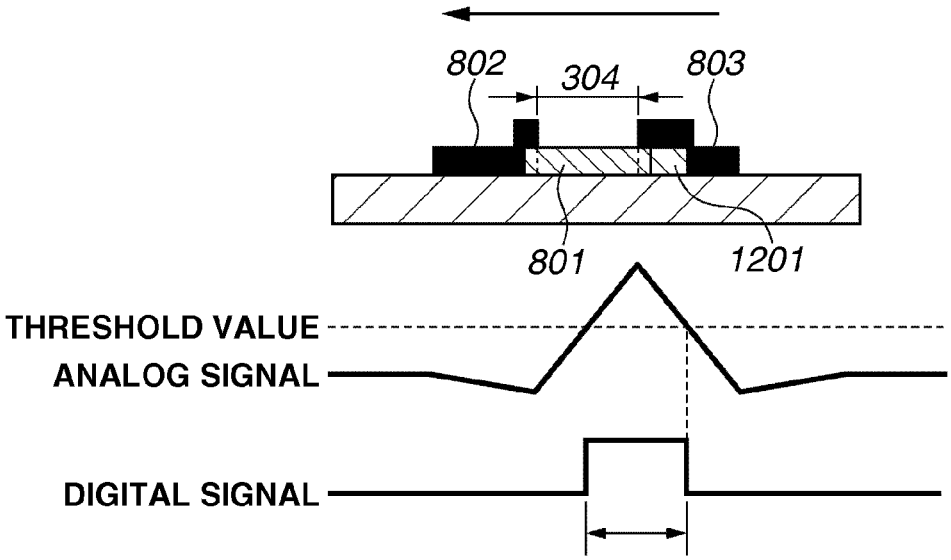
Figure 13A:
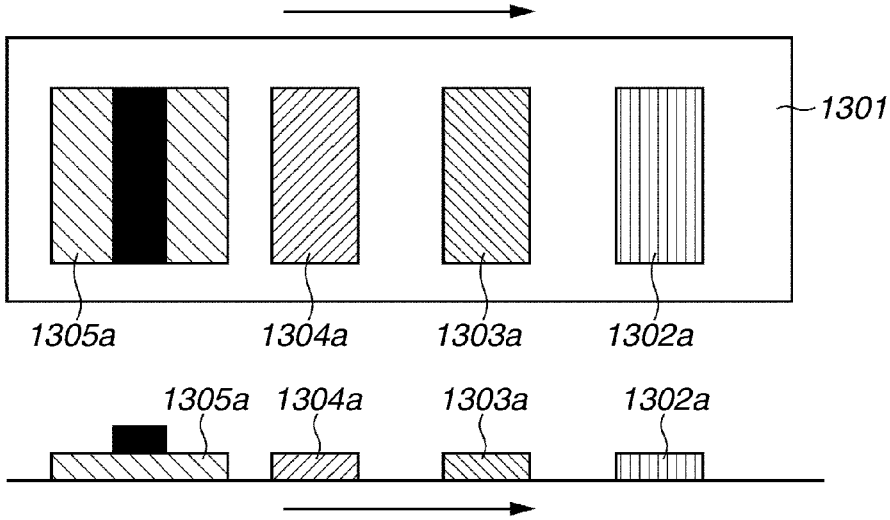
FIG.13A PRIOR ART
FIGS. 13A, 13B and 13C illustrate a conventional combination toner pattern, a waveform of an analog signal obtained from detection of the combination toner pattern, and a waveform of a digital signal generated from the analog signal.
Figure 13B:
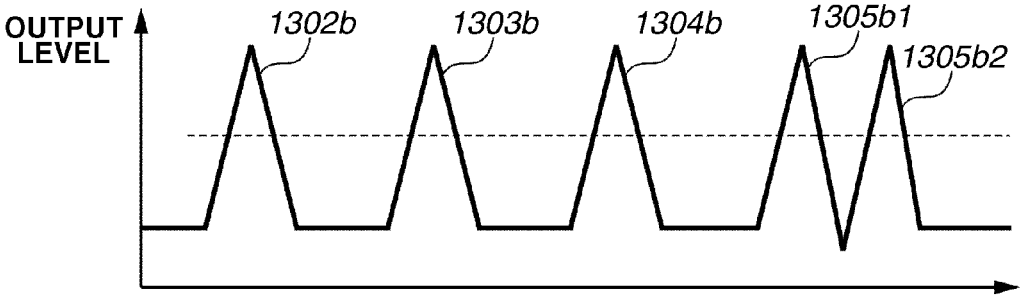
FIG.13B PRIOR ART
Figure 13C:
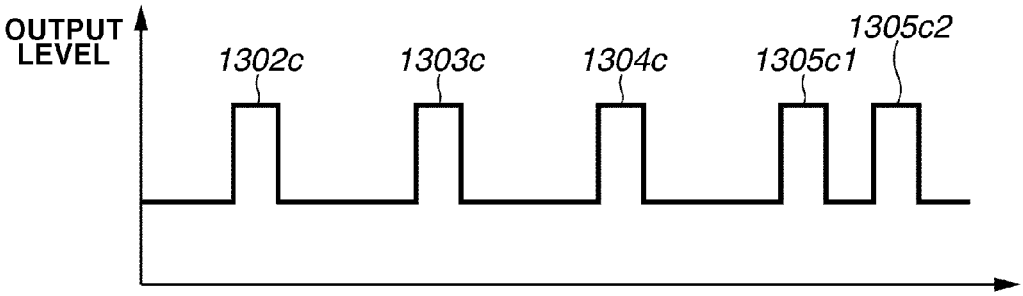
FIG.13C PRIOR ART

FIG. 12B illustrates a case where the third toner image 803 is superposed on the density-reduced region of the first toner image 801. In this case, since the amount of diffused reflection light reflected from the pattern of the first toner image 801 when the first toner image 801 is detected is constant, the waveform is not affected by the density-reduced region 1201 of the first toner image 801. Accordingly, a desired sensor output waveform can be obtained. If the binarization output using the threshold value is obtained from the output waveform, accurate position of the black toner pattern can be detected. As a result, color misregistration correction control can be performed with accuracy.

By forming a combination toner pattern as described above, the position of the black toner pattern can be identified from one output waveform of an analog signal.

Performance of the cleaning unit has a certain cleaning limit (limit of the toner that can be scraped). Thus, the amount of toner used in forming the toner pattern needs to be smaller than the cleaning limit. According to the combination toner pattern 304 described in the first exemplary embodiment, the second and the third toner images which are black images are formed on the first toner image 801 (magenta image). In other words, the combination toner pattern 304*a* includes some overlapping regions. Thus, amount of toner of the combination toner pattern 304 is controlled so that the amount of toner that is scraped is as small as possible.

Since the trailing edge of the first toner image 801 (magenta image) is formed under the third toner image 803, the density of that region is not reduced. Thus, the necessary amount of toner in that region is slightly above the amount corresponding to level D (threshold value) regarding the detection result of the first toner image. On the other hand, since the second toner image 802 and the third toner image 803 (black images) are formed on the first toner image 801, the black images need to be formed so that the density-reduced region is not generated.

Thus, according to the image forming apparatus of the second exemplary embodiment, the first toner image 801 (magenta) is set so that its toner amount is smaller than the amount of black toner of the second toner image 802 and the third toner image 803. Further, the amount of toner of the first toner image is set so that the output level obtained when the first toner image is detected is slightly above the threshold value illustrated in FIG. 9A. Further, the amount of toner (density) of the first toner image 801, the second toner image 802, and the third toner image 803 is set in consideration of the cleaning limit of the cleaning unit as well as the above-described setting.

Other Embodiments

Aspects of the present invention can also be realized by a computer of a system or apparatus (or devices such as a CPU, a micro-processing unit (MPU), and/or the like) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., a computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-113435 filed May 17, 2010 and No. 2011-082981 filed Apr. 4, 2011 which are hereby incorporated by reference herein in their entirety.

What is claimed is:

1. A color image forming apparatus comprising:

an image bearing member to be rotationally driven;

a first image forming unit configured to form a chromatic color toner image on the image bearing member;

a second image forming unit configured to form an achromatic color toner image on the image bearing member;

a control unit configured to cause the first and the second image forming units to form a first detection toner pattern having the achromatic toner image superposed upon the chromatic color toner image and to cause the first image forming unit to form a second detection toner pattern having the chromatic color toner image, wherein the first detection toner pattern is a detection toner pattern of the achromatic color toner image being superimposed upon the chromatic color toner image with an interval in a rotation direction of the image bearing member;

an emission unit configured to emit light on the first detection toner pattern, the second detection toner pattern, or the image bearing member;

a light-receiving unit configured to receive a light reflected from the first detection toner pattern, the second detection toner pattern, or the image bearing member, and generate a signal according to an amount of the received light; and a detection unit configured to identify a relative position of the chromatic color toner image and the achromatic color toner image on the image bearing member by detecting, based on the signal generated by the light-receiving unit, the relative position of the chromatic color toner image included in each of the first and the second detection toner patterns, wherein the second image forming unit forms the achromatic color toner image included in the first detection toner pattern so that the achromatic color toner image that is superimposed on an upstream side of the chromatic color toner image included in the first detection toner pattern is longer than the achromatic color toner image that is superimposed on a downstream side of the chromatic color toner image included in the first detection toner pattern in the rotation direction of the image bearing member.

2. The color image forming apparatus according to claim 1, wherein the light-receiving unit receives a diffused reflection light reflected from the first detection toner pattern, the second detection toner pattern, or the image bearing member.

3. The color image forming apparatus according to claim 1, wherein the second image forming unit forms the achromatic color toner image included in the first detection toner pattern so that the achromatic color toner image included in the first detection toner pattern covers a density region, having a predetermined density or lower and generated upstream in a moving direction of the image bearing member, of the chromatic color toner image included in the first detection toner pattern.

4. The color image forming apparatus according to claim 3, wherein the image forming unit includes a developing unit configured to form a toner image on the image bearing member with developer including toner and carrier which charges the toner.

5. A color image forming apparatus comprising:

an image bearing member that member to be rotationally driven;

a first image forming unit configured to form a chromatic color toner image on the image bearing member;

a second image forming unit configured to form an achromatic color toner image on the image bearing member;

a control unit configured to cause the first and the second image forming units to form a detection toner pattern having the achromatic toner image superposed upon the chromatic color toner image, wherein the detection toner pattern is a detection toner pattern of the achromatic color toner image being superimposed upon the chromatic color toner image with an interval in a rotation direction of the image bearing member;

an emission unit configured to emit light on the detection toner pattern;

a light-receiving unit configured to receive a light reflected from the detection toner pattern; and a detection unit configured to identify a position of the achromatic color toner image of the detection toner pattern on the image bearing member by detecting the chromatic color toner image included in the detection toner pattern based on an output of the light-receiving unit, wherein the second image forming unit forms the achromatic color toner image included in the detection toner pattern so that the achromatic color toner image that is superimposed on an upstream side of the chromatic color toner image included in the detection toner pattern in the rotation direction of the image bearing member is longer than the achromatic color toner image that is superimposed on a downstream side of the chromatic color toner image included in the detection toner pattern in the rotation direction of the image bearing member.

6. The color image forming apparatus according to claim 5, wherein the light-receiving unit receives a diffused reflection light reflected from the detection toner pattern or the image bearing member.

7. The color image forming apparatus according to claim 5, wherein the second image forming unit forms the achromatic color toner image included the detection toner pattern so that the achromatic color toner image included in the detection toner pattern covers a density region, having a predetermined density or lower and generated upstream in a moving direction of the image bearing member, of the chromatic color toner image included in the detection toner pattern.

8. The color image forming apparatus according to claim 7, wherein the image forming unit includes a developing unit configured to form a toner image on the image bearing member with developer including toner and carrier which charges the toner.

* * * * *